United States Patent [19]

Bowman et al.

[11] 4,165,691

[45] * Aug. 28, 1979

[54] DELAY DETONATOR AND ITS USE WITH EXPLOSIVE PACKAGED BOOSTERS AND CARTRIDGES

[75] Inventors: Arthur F. Bowman; Francis J. Camerini, both of Tamaqua, Pa.

[73] Assignee: Atlas Powder Company, Dallas, Tex.

[ * ] Notice: The portion of the term of this patent subsequent to Nov. 29, 1994, has been disclaimed.

[21] Appl. No.: 828,780

[22] Filed: Aug. 29, 1977

[51] Int. Cl.[2] ..... F42B 3/10

[52] U.S. Cl. ..... 102/24 R; 102/27 R

[58] Field of Search ..... 102/24 R, 27 R

[56] References Cited

U.S. PATENT DOCUMENTS 4,060,033 11/1977 Postupack et al. ..... 102/24 R 4,060,034 11/1977 Bowman et al. ..... 102/24 R

*Primary Examiner*—Verlin R. Pendegrass

*Attorney, Agent, or Firm*—Richards, Harris & Medlock

[57] ABSTRACT

A nonelectric delay detonator for use with an explosive packaged booster or explosive cartridge wherein the detonator includes a detonation sensor which senses the detonation of a detonating cord, and a signal carrier consisting of an empty plastic or rubber tube having a diameter of 1.0–4.0 millimeters which transmits the detonation signal from the sensor to a non-electric delay blasting cap. One end of the tube signal carrier is inserted into the sensor while the opposite end of the tube is inserted into the cap whereby the tube is in open and direct communication with the sensor and cap.

10 Claims, 8 Drawing Figures

DELAY DETONATOR AND ITS USE WITH EXPLOSIVE PACKAGED BOOSTERS AND CARTRIDGES

This application is a continuation-in-part of patent application Ser. No. 665,298 filed Mar. 9, 1976, and now Pat. No. 4,060,034.

BACKGROUND OF THE INVENTION

In open pit mines, open pit rock quarries, and other types of open pin mining operations, blasting is carried out to remove overburden covering an orebody, to break ore to allow it to be loaded and hauled away. The blasting part of these operations must be carried out to optimize the use of the available explosive energy. This includes obtaining the desired breakage and throw of the ore and rock. While accomplishing the above, it is becoming increasingly important to minimize the effects of blasting on nearby structures such as homes, schools, offices, etc. One significant way in which such blasting can affect nearby structures is through the ground vibration produced by the blast.

Several methods are being used to minimize ground vibration and still obtain the desired blasting results. These generally involve minimizing the amount of explosives detonated at a given time by separating a shot into a number of small blasts that are individually detonated in time sequence. Some examples of these methods are:

a. The use of delay electric blasting caps.
b. The use of nonelectric delay blasting caps.
c. The use of decked charges (explosive charges in a borehole separated by an insert barrier).
d. The use of detonating cord with delay connectors.
e. The use of delay electric blasting caps in combination with a sequential blasting machine which effectively increases the number of available periods of delaying the shot firing between individual cap circuits.

DESCRIPTION OF THE INVENTION

The present invention provides a simple, easy to use, nonelectric delay system for use in open pit mines and quarries to minimize blast vibration and still obtain the desired blasting results. The system consists of a delay detonator for use in conjunction with either a packaged booster or an explosive cartridge or shell. The booster package may be a plastic bottle filled with explosives such as sensitized ammonium nitrate, PETN, Composition B, Pentolite, TNT, and slurry compositions. The explosive cartridge or shell may contain explosives such as nitroglycerine based powders and slurry compositions.

The nonelectric delay detonator consists of a detonation sensor which senses the detonation of a detonating cord downline and which is constructed of a metal shell, e.g. copper, copper alloy, aluminum or aluminum alloy, preferably aluminum alloy and contains one or more explosive charges. The thickness of the metal shell bottom for a given metal must be adjusted so as to allow the shock energy from the detonating cord downline to be transmitted through the bottom and initiate the adjacent explosive charge in the sensor. For example, the bottom thickness of an aluminum shell should be between 0.005" and 0.025". The explosives in the sensor must be sensitive to initiation by the shock energy from detonating cord, e.g. diazo, lead azide, lead styphnate.

The sensor explosive must have sufficient output to transmit a shock signal through an empty tube signal carrier one end of which is inserted into the sensor, and ignite a pyrotechnic mixture in a nonelectric blasting cap into which the opposite end of the empty tube is inserted.

The signal carrier consists of an empty plastic or rubber tube, preferably plastic, which because of the fact that it is completely empty with no chemical or explosive material therein, it acts as a passive signal carrier and does not itself enter into any reaction. This signal tube may take the form of a rigid tube with a fixed angle bend, such as L-shaped, in the tube or of a flexible tube capable of conforming to various configurations. The signal carrier tube preferably has an inside diameter of 1.0–4.0 millimeters and a length of about 25–2000 mm while the outside diameter substantially conforms to the inside diameter of the sensor and the cap. When the tube is L-shaped it preferably has an inside diameter of 1.6 mm and a length of about 100 millimeters which is approximately the distance between the sensor explosive and the delay pyrotechnic mixture in the cap. When the tube is flexible and substantially straight, the length is preferably about 750 millimeters.

The nonelectric delay blasting cap is applied over the opposite end of the signal tube and consists of a metal shell made of copper, copper alloy, aluminum, aluminum alloy, or steel which is closed at one end. A base or main explosive such as PETN is located in the extreme bottom or closed end of the metal shell. A primer explosive charge such as diazo, lead azide, HNM, diazo/HNM, lead styphnate/lead azide is located directly above and in contact with the base explosive charge. A metal capsule formed of copper, zinc, steel or aluminum may or may not be used above the primer charge to hold the explosive charges in place. A delay element located above the capsule or primary charge is designed to burn at a controlled rate. Examples of the burning time of such a delay element would be 25, 50, 75, 100 milliseconds, etc. This burning time would be extended to several seconds if desired by the proper selection of the pyrotechnic delay powder. A delay element would consist of a metal tube, lead, brass, aluminum or lead with a plastic jacket containing a pyrotechnic powder mixture such as $Pb_3O_4/B$, $Pb_3O_4/Si$, $Pb_3O_4/Si/B$. A delay element of the plastic jacketed lead type could be held in place by means of the suitable crimp in the metal shell. An empty metal, brass or aluminum, or plastic tube containing a small hole, e.g. 0.040", is positioned above the delay element. The small hole in this tube would serve to focus and direct the shock signal from the detonation sensor directly upon the pyrotechnic powder mixture in the delay element. This empty tube would be preferably constructed to allow venting of the pressure generated by the burning pyrotechnic delay powder. Such venting can be accomplished by the use of flutes along the side of the tube. Finally, a plastic or rubber sealing plug which would preferably be the empty signal tube enters the open end of the cap shell. This combination signal tube/sealing plug would be held in place in the open end of the shell by suitable crimps in the shell wall.

As to the operation of the empty tube delay detonator, the explosive charge in the sensor is initiated by the detonating cord downline and the shock signal from the detonation of the sensor explosives is carried inside the blasting cap by the empty tube signal carrier. The empty metal or plastic tube containing the small hole focuses and directs this shock wave onto the pyrotechnic delay powder in the delay element which shock wave ignites the pyrotechnic delay powder in the delay element and the heat from this burning pyrotechnic powder mixture ignites the primer explosive charge which converts this ignition heat to a detonation. The primer explosive charge initiates the main or base explosive charge.

The ability of an empty tube to carry a detonation signal from a sensor to a nonelectric blasting cap is illustrated with the following experimental results:

| Total Explosive Weight In Sensor-Grams | Empty Tube Diameter - Millimeters | Empty Tube Shape | Receiver Material In Blasting Cap Being Ignited | Distance In Millimeters For An Ignition Frequency of 50% |
|---|---|---|---|---|
| 0.50 | 1.6 | Straight | Diazo | 457 |
| 0.50 | 3.2 | Straight | Diazo | 1829 |
| 0.10 | 1.6 | L-Shaped | $Pb_3O_4$/B | 610 |
| 0.10 | 3.2 | L-Shaped | $Pb_3O_4$/B | 914 |

DETAILS OF THE INVENTION

A better understanding of the invention may be had from a study of the following description and drawings wherein.

Figure 1:
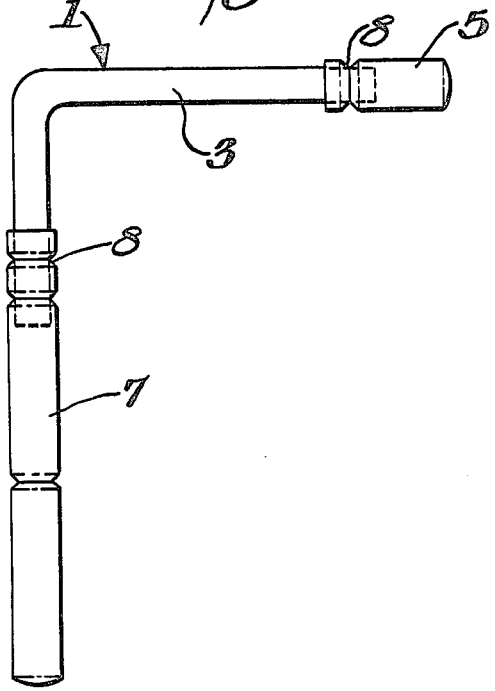
FIG. 1 is an elevation of the rigid L-shaped delay detonator of the present invention as used with an explosive packaged booster.

The delay detonator 1 shown in FIG. 1 can be used with an explosive packaged booster bottle as will be described later. The delay detonator consists of a substantially rigid L-shaped plastic tube 3 with a detonation sensor 5 applied over one end of the tube and a nonelectric delay blasting cap 7 applied over the opposite end of the tube. Both the sensor 5 and the cap 7 are anchored to the tube 3 by crimps 8 in the sensor and cap shells. The term "empty tube" means that there are no chemical or other ignitable coatings on the inner surface of the tube which might enter into any chemical or physical reaction. The weight of the explosive material, as previously identified and described, in the sensor varies from about 0.10–0.50 grams and the inner diameter of the tube 3 is about 1.0–4.0 millimeters. The ends of the tube 3 are completely open thus providing open and direct communication with the sensor 5 and the cap. The explosive material in the cap 7 was previously identified and described. Preferably, the L-shaped tube 3 is about 100 millimeters in length which is the distance from the sensor to the pyrotechnic material in the cap.

Figure 2:
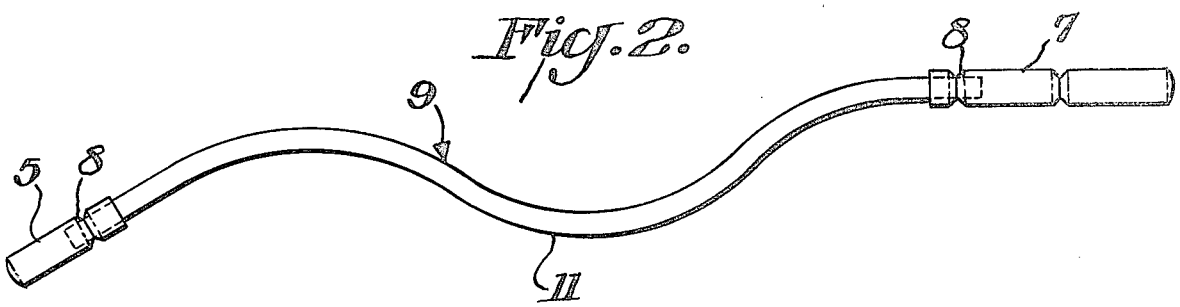
FIG. 2 is an elevation of the flexible delay detonator of greater length which is used with an explosive packaged shell or cartridge.

A more flexible delay detonator 9 is shown in FIG. 2 for use with explosive packaged cartridges or shells. Here the tube 11 is formed of rubber or a more flexible plastic material than is used in FIG. 1. The length of the tube in this instance can vary preferably from about 400–2000 millimeters and the inside diameter of the tube is again 1.0–4.0 millimeters. The sensor 5 and nonelectric delay detonator 7 are applied over opposite ends of the tube 9 in the manner stated with FIG. 1.

Figure 3:
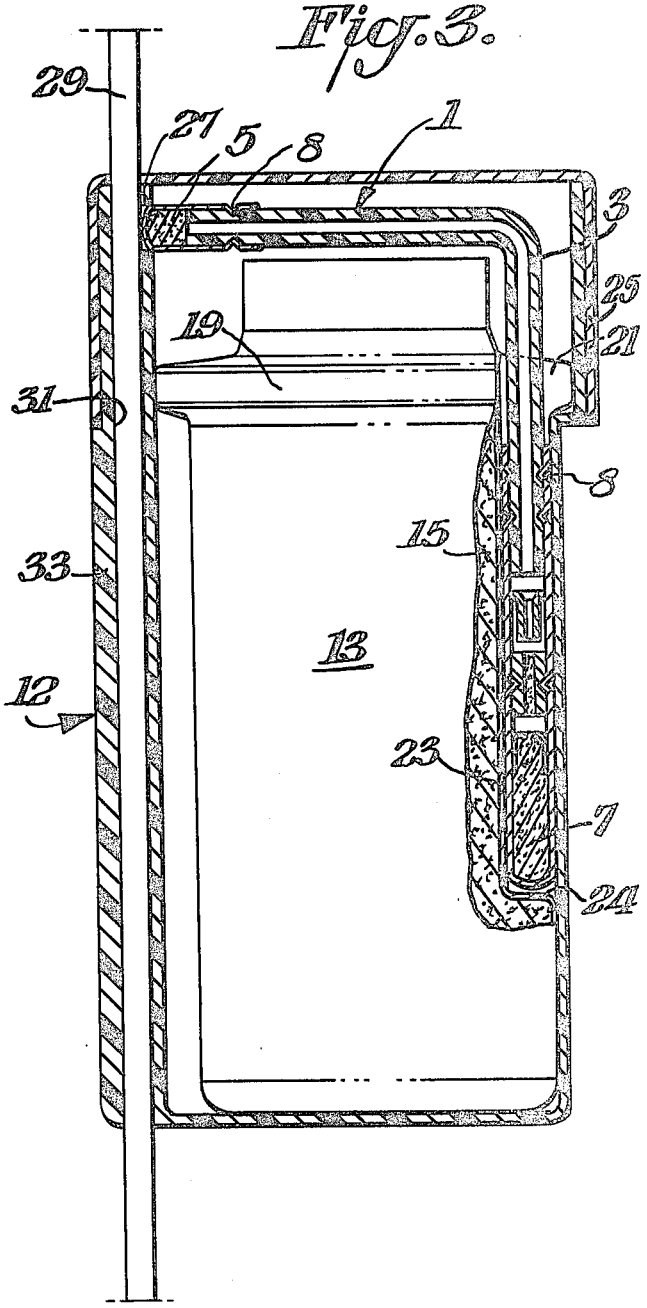
FIG. 3 is a cross-section of a delay booster bottle assembly.

The use of the delay detonator 1 with an explosive packaged booster bottle is illustrated in FIG. 3. The assembly 12 includes a plastic bottle 13 which contains explosive material 15 as identified and described earlier in the specification. A cap 17 seals off the mouth of the bottle 13. An upper shoulder portion 19 of the bottle extends around the top portion of the bottle 13 and has a vertical indentation 21 which extends through the shoulder 19 through which the vertical leg of the L-shaped delay detonator 1 extends. As also shown, the side wall of the bottle below the indentation 21 includes a vertical indentation 23 which accommodates the vertical leg of the L-shaped delay detonator 1.

The horizontal leg of the L-shaped delay detonator 1 lies above and over the bottle cap 17 extending therebeyond as shown in the drawing.

The bottle 13 with the delay detonator 1 in position as shown in the drawing is enclosed in a booster casing 24 which has a lid or cap 25 for closing off the top of the casing. The tip of the sensor lies immediately adjacent to but out of contact with a detonating cord 29 which is threaded through channel 31 extending the length of the casing 24 and formed in an expanded or thickened portion 33 of the wall of casing 24 and its cover 25. The channel 31 is open on the side facing the sensor 5.

The nonelectric delay detonator 7 and the sensor 5 contain the explosive and other elements as described earlier in the specification. The delay detonator 1 is assembled in the bottle at the blasting site.

Figure 4:
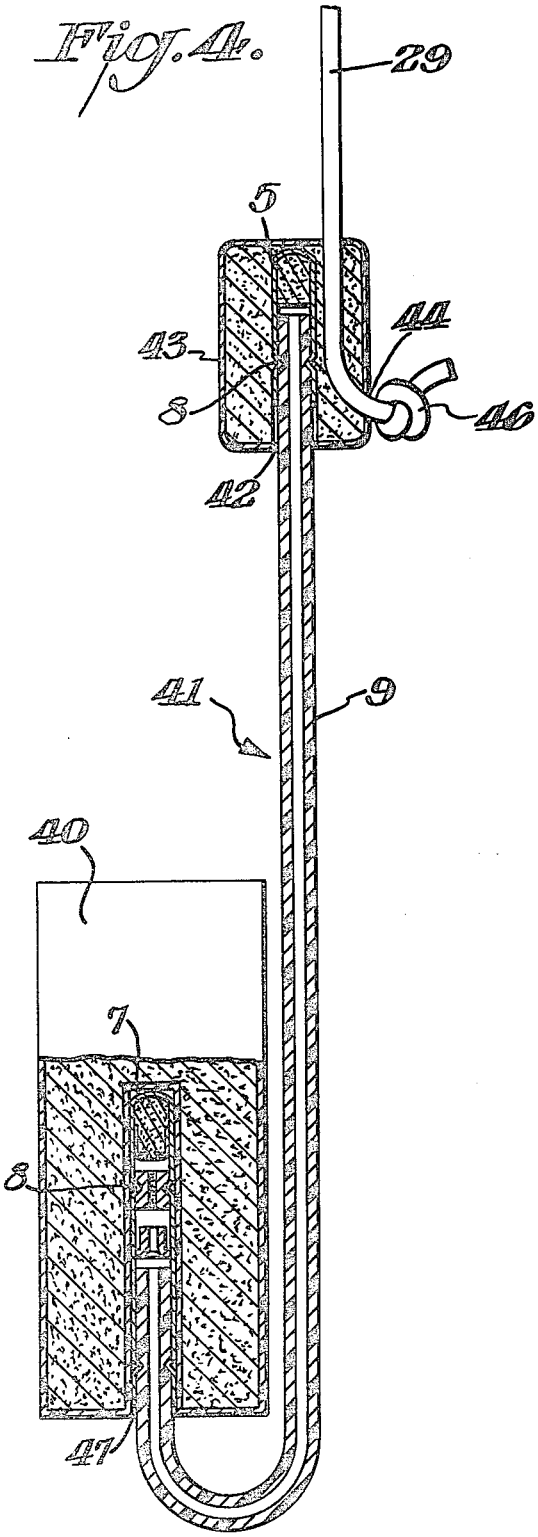
FIG. 4 is a cross-section of a delay explosive cartridge or shell assembly.

FIG. 4 illustrates the present invention as used with explosive packaged cartridges or shells 40. As seen therein, the assembly 41 includes the sensor 5 affixed to one end of the flexible empty tube 9 and is supported in a passageway 42 of a coupler 43 as is the adjacent detonating cord 29 in passageway 44. The free end of the cord 29 extending through an opening 44 is knotted as at 46 to prevent the cord from accidentally being pulled out of the coupler 42. As shown and as with the other embodiments the sensor 5 lies adjacent to but out of contact with the cord 29.

The nonelectric delay blasting cap 7 affixed to the opposite end of the carrier tube 9 is lodged within a cap well 47 formed in the explosive cartridge or shell 40 as shown in the drawing. The sensor 5, the nonelectric delay detonator 7 and the cartridge 40 contain the explosive material specified earlier in the specification. The delay detonator 7 is assembled in the cartridge at the blasting site.

Figure 5:
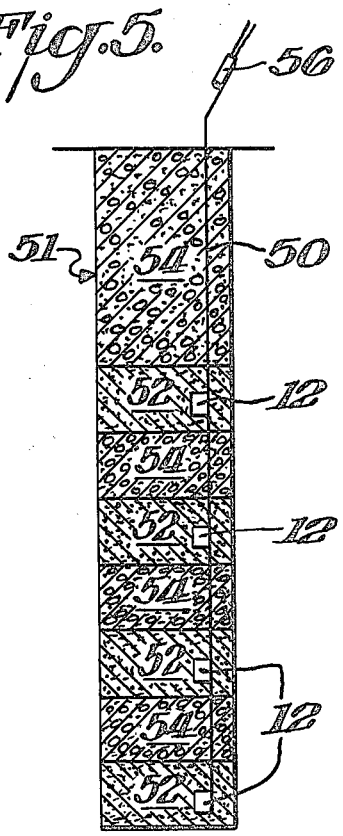
FIGS. 5–7 are schematics illustrating different ways in which the delay booster assemblies of the present invention can be used in blasting operations.

FIG. 5 illustrates one way in which the present invention can be used in borehole blasting operations. A single detonating cord downline 50 extends into the borehole 51 which is loaded with alternating layers of bulk explosive charge 52 such as ANFO and inert stemming material 54 such as sand, sized stone, drill cuttings, etc. Connected to the downline 50 are the delay booster assemblies 12 having different millisecond delay times. The delay booster assembly 12 at the top of the hole 51 may typically have a delay time of 100 milliseconds while the three delay booster assemblies 12 below the top assembly 12 may typically have delay times of 75, 50 and 25 milliseconds, as they extend downwardly toward the bottom of the borehole. The downline 50 is initiated by the electric blasting cap 56 attached to that portion of the downline above the borehole which in turn activates the topmost delay booster assembly 12 and then progressively initiates the booster assemblies therebelow. Because of the different delay times of the delay booster assemblies 12, the explosive charges 52 detonate in timed sequence starting with the bottommost one and proceeding to the topmost one.

Figure 6:
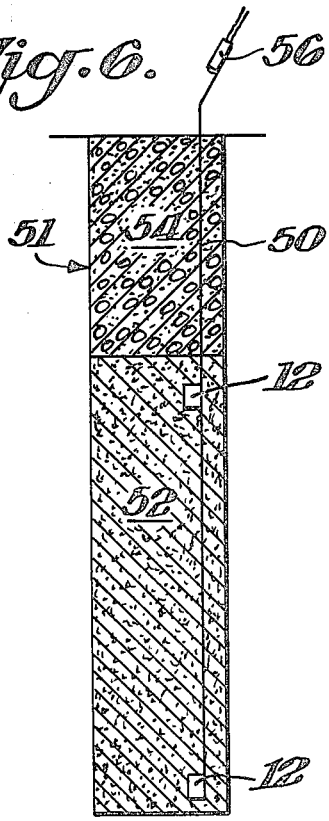

FIG. 6 depicts another way in which the delay booster assemblies 12 are used in borehole blasting operations. As with the operation of FIG. 5, the downline 50 extends to the bottom of the borehole 51. Explosive material 52 as described previously fills up the hole preferably more than halfway and is topped with the inert stemming material 54. This differs from the FIG. 5 system in that the explosive material 52 is not alternately layered with the inert stemming material 54. A booster assembly 12 is connected to the downline near the bottom of the hole and also near the upper level of the explosive material 52. As with the operation of FIG. 5, the electric blasting cap 56 is initiated which in turn initiates the downline 50 to activate the upper and then the lower booster 12. Since the lower assembly 12 is delay timed faster than the upper assembly the lower assembly will detonate before the upper assembly 12.

Figure 7:
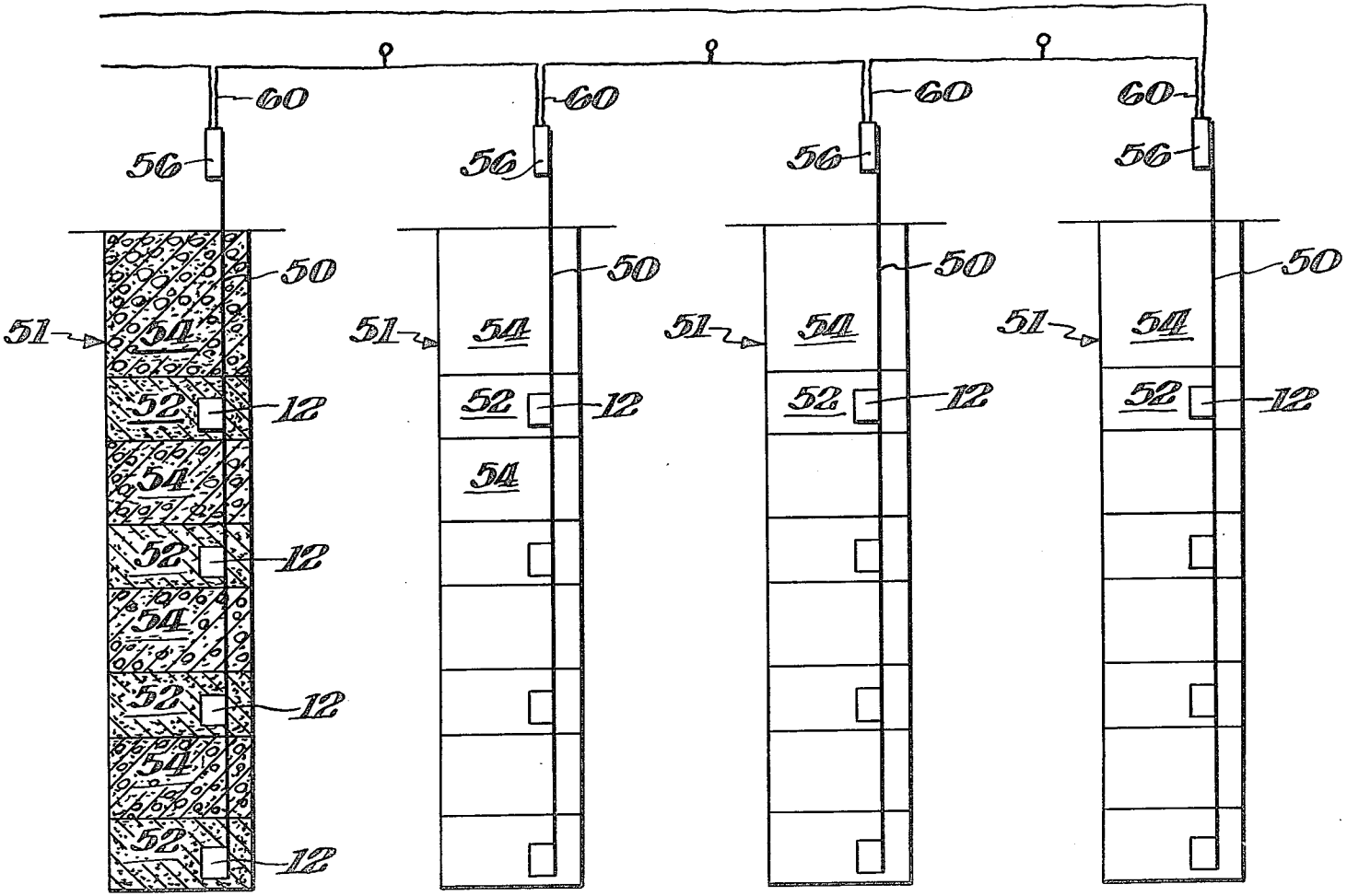

FIG. 7 illustrates an example of deck loading using the booster assembly 12 of the present invention in a series of boreholes 51. Each borehole is loaded in the same manner as discussed above with respect to FIG. 5 except that the electric blasting caps 56 which initiate the downline 50 in each borehole 51 are time delayed in progressive manner extending from left to right when viewing the drawing. The cap 56 on the extreme left is an instantaneous cap while the cap next to it is a 125 millisecond delay cap and the caps on the two right side boreholes are 250 and 400 millisecond delay caps, respectively. The caps 56 are connected by conductive wirings 60 which detonate the caps and they will initiate their respective downline 50 in delay timed order extending from left to right as one looks at FIG. 7. These delays acting in combination with the delays provided by the delay boosters 12 provide a time sequence detonation of the individual deck charges 52 such that they occur at different instants in time.

If it is desired to confine all explosive detonations under the earth's surface, the deck loading arrangement shown in FIG. 7 could be altered by locating the caps 56 at the bottom of each borehole 51. The upper end of each detonating cord 50 would then be buried in the topmost stemming deck 54 in each borehole. The caps 56 would then initiate each detonating cord 50 in timed sequence at the bottom of each borehole and the cord detonation would proceed toward the top of each borehole. In this case, the detonating cord 50 would be termed an upline.

Figure 8:
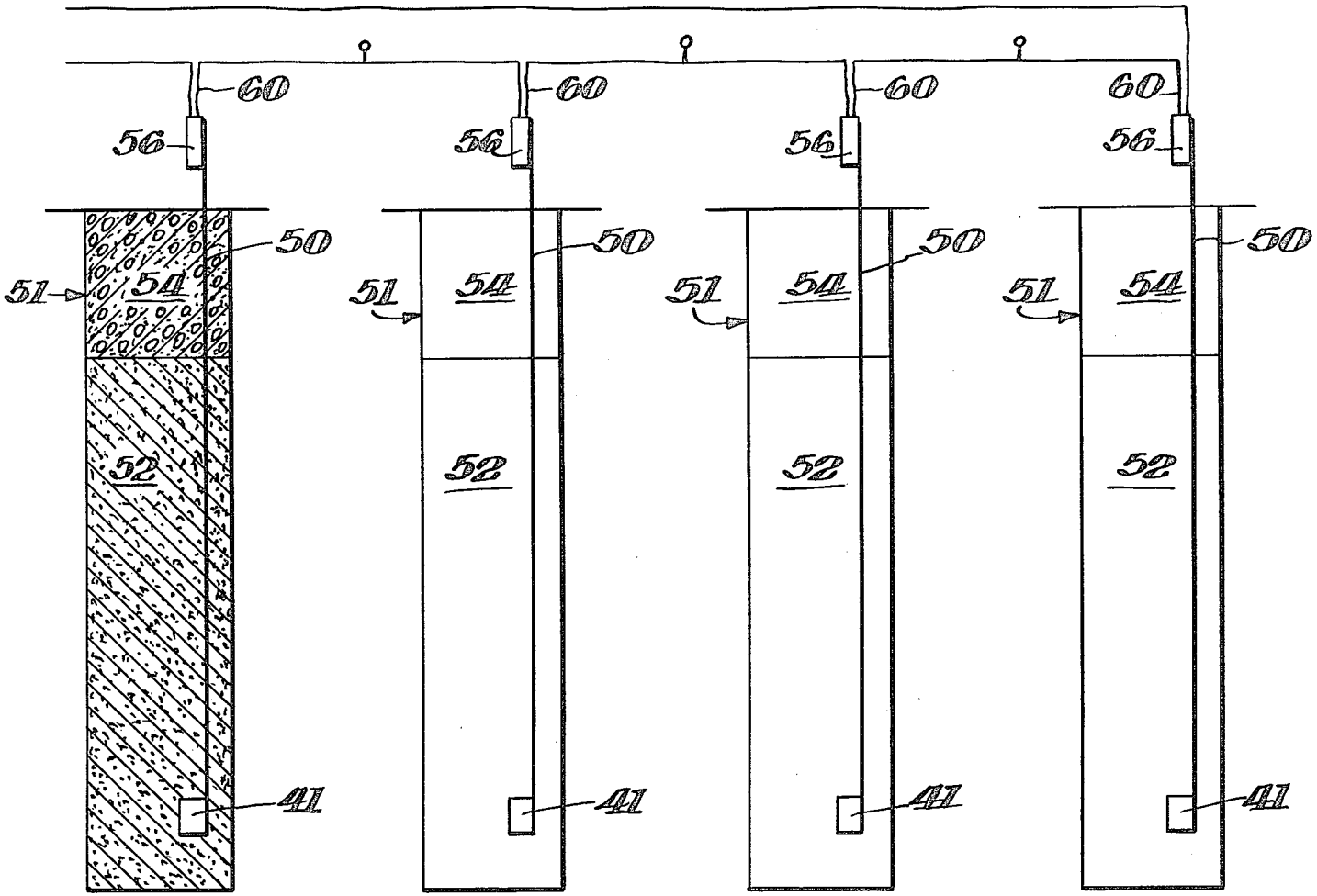
FIG. 8 is a schematic illustrating one manner in which the delay explosive cartridge or shell of the present invention can be used in blasting operations.

FIG. 8 illustrates the invention with the use of delay cartridge assembles 41. The system is similar to that of FIG. 7 except that the boreholes 51 are filled more than halfway with explosive material 52. The delay detonation timing sequence is controlled by the time delay caps 56 as well as by the delay cartridges 41. The cap 56 on the extreme left is an instantaneous cap while the cap next to it is a 25 millisecond delay cap and the cap on the two right side boreholes are 50 and 75 millisecond delay caps, respectively.

In summary, the functioning of an empty tube delay detonator in combination with a detonating cord downline and a booster or explosive cartridge is as follows:

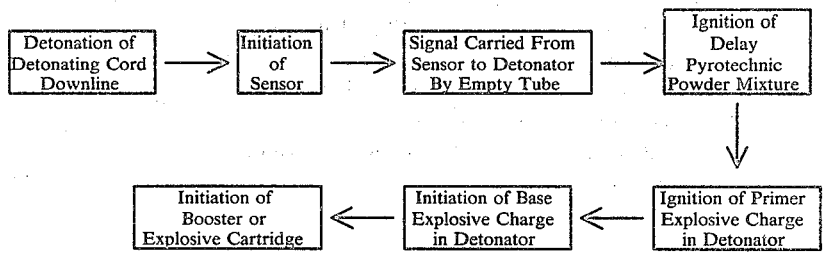

ADVANTAGES OF THE INVENTION

The particular advantages offered by this invention are as follows:

(a) Multiple or decked explosive charges in a borehole can be initiated separately using a single detonating cord downline with boosters and L-shaped empty tube delay detonators.

(b) The time at which such multiple or decked explosive charges are to be initiated can be controlled by selection of an empty tube delay detonator with the desired delay time.

(c) Since the L-shaped empty tube delay detonator and booster would be assembled just prior to use, one type of booster could be used for all of the L-shaped empty tube delay detonators.

(d) Loading of the L-shaped empty tube delay detonator-booster assembly into the borehole can be easily accomplished by sliding the assembly down a detonating cord.

(e) The flexible empty tube delay detonators shown in FIG. 2 can be used in combination with most any conventional explosive cartridge.

(f) The flexible empty tube delay detonator-explosive cartridge assembly shown is such that the detonating cord downline is separated from the explosive cartridge and therefore the explosive inside of the cartridge would not be prematurely affected by the detonation of this downline.

(g) Empty tube delay detonators with the same delay time can be used in more than one borehole or deck by delaying the detonation of the individual detonating cord downline using electric or nonelectric delay blasting caps.

(h) The reliability of the empty tube delay detonator is assured by the use of the sensor which relays the signal from the detonating cord downlines through the empty tube to the inside of the delay detonator.

What is claimed is:

1. A nonelectric delay detonator comprising a nonelectric blasting cap which is open at one end and contains a base explosive material positioned in the opposite extreme end of the cap with a delay material positioned above the base explosive material, a passive signal carrier in the form of an empty open ended tube having an inner diameter of 1.0–4.0 millimeters, said carrier extending from a point externally of the cap into the open end of said cap, and a detonation sensor applied over the opposite end of the carrier tube, said carrier tube lying in open and direct communication with sensor and said cap.

2. The delay detonator of claim 1 wherein the carrier tube has a length of about 25–2000 millimeters.

3. The delay detonator of claim 1 wherein the carrier tube is made of a flexible rubber material.

4. The delay detonator of claim 1 wherein the carrier tube is made of a plastic material.

5. The delay detonator of claim 4 wherein the plastic material is a substantially rigid material.

6. The delay detonator of claim 1 wherein the carrier tube is substantially straight.

7. The delay detonator of claim 5 wherein the carrier tube is L-shaped and has a length of about 25–1000 millimeters.

8. The nonelectric delay detonator of claim 1 wherein the cap and the sensor have carrier tube receiving portions and the outside diameter of the carrier tube substantially conforms to the inside diameter of the cap and the sensor.

9. The nonelectric delay detonator as recited in claim 1 further comprising an explosive filled cartridge into which is lodged within the cartridge interior said nonelectric delay blasting cap with said open end being accessible externally of said cartridge, a detonating cord positioned adjacent said detonating sensor, and a coupler unit which supports said detonating sensor and said detonating cord.

10. The nonelectric delay detonator as recited in claim 9 wherein the carrier tube is about 25–2000 milliliters in length.

* * * * *